United States Patent [19]

Virk et al.

[11] 4,165,721

[45] Aug. 28, 1979

[54] EXHAUST GAS RECIRCULATION SYSTEM FOR AN AUTOMOTIVE ENGINE

[75] Inventors: Kashmir S. Virk, Hopewell Junction; Henry E. Leikkanen, Beacon, both of N.Y.

[73] Assignee: Texaco Inc., New York, N.Y.

[21] Appl. No.: 811,667

[22] Filed: Jun. 30, 1977

[51] Int. Cl.[2] ..... F02M 25/06

[52] U.S. Cl. ..... 123/119 A

[58] Field of Search ..... 123/119 A, 190 DA, 97 B

[56] References Cited

U.S. PATENT DOCUMENTS

| | | | |
|---|---|---|---|
| 1,384,133 | 7/1921 | Howe | 123/119 A |
| 1,987,105 | 1/1935 | Hall | 123/190 DA |
| 3,019,778 | 2/1962 | Kloss | 123/97 B |
| 3,397,682 | 8/1968 | Riggan | 123/119 A |
| 3,412,722 | 11/1968 | Epifano, Sr. | 123/119 A |
| 3,579,981 | 5/1971 | Gau | 123/119 A |

*Primary Examiner*—Wendell E. Burns

*Attorney, Agent, or Firm*—Thomas H. Whaley; Carl G. Ries; Robert B. Burns

[57] ABSTRACT

Exhaust gas recirculation system for an automotive engine in which that portion of the exhaust stream is selectively withdrawn which contains the major amount of undesirable ingredients. Said portion of gas from each cylinder is received in a common mixing chamber and thereafter passed to the inlet side of the engine for mixing with fresh charge entering the combustion chamber.

12 Claims, 3 Drawing Figures

EXHAUST GAS RECIRCULATION SYSTEM FOR AN AUTOMOTIVE ENGINE

BACKGROUND OF THE INVENTION

The instant invention relates to environmental control in general, and specifically to the prevention of smog through the reduction of objectionable constituents which would otherwise be discharged into the atmosphere. The latter are often found in varying degrees in the exhaust fumes of internal combustion and diesel engines.

It is known that by recirculating all or a part of the exhaust created by an engine, the amount of pollutants which enter the atmosphere can be reduced. To foster this concept regulations have been imposed which are becoming more stringent. Their objective is to minimize the amount of pollutants which will be discharged into the atmosphere regardless of the engine's running status.

This gas recirculation is normally achieved by extracting at least a part of the exhaust gas stream and reintroducing it at some point where it will mix with the initial charge entering the engine's respective combustion chambers.

One problem inherent with the extraction of the exhaust stream for recirculation, is that different engines operate, exhibiting different firing characteristics in the combustion chambers. It has been found generally, however, that the major part of the undesirable pollutants, such as hydrocarbons are discharged during the exhaust stroke, at the beginning of the stroke and at the end thereof. Thus, to recirculate a part of the exhaust gas stream for reburning with the initial charge, it has been found that the overall charge introduced to the cylinder's inlet valves lacks uniformity and can vary widely in quality.

Because of the desire to control the combustion event in any cylinder, and thereby to a degree to control the quality of the exhaust gas, it has become desirable to regulate more closely the composition of the overall charge. That is, in the instance of a premixed charge, the air and fuel, as well as the exhaust gas, are combined to form the aggregate charge. To have the engine work efficiently and satisfactorily from the point of view of emissions control, it is desirable to maintain a degree of uniformity and consistency in this initial aggregate charge.

It has been determined as noted, that a major portion of the undesirable constituents which make up any exhaust charge, are discharged from the cylinder during particular periods of the exhaust stroke. In one example it was found that approximately 40% of the hydrocarbons were discharged from the cylinder in the first 5° to 10° of travel of the exhaust stroke. Of the remaining charge, 50% of these constituents were discharged during the last 10° to 15° of travel.

It has been determined therefore that an acceptable amount of undesirable constituents entering the atmosphere can be tolerated and controlled. The present system thereby provides a means for intermixing the exhaust gas which is drawn from each of a plurality of cylinders in the engine. Further the segment of said exhaust gas is extracted during the final part of the engine stroke.

The system includes means to sequentially introduce a sufficient portion of the exhaust charge from each cylinder into a common chamber. Thereafter, from this chamber the exhaust gas is metered, and fed to the intake manifold or to the air filter. Thus, said aggregate exhaust gas can be readily mixed with incoming charge whether the latter be premixed, stratified, or otherwise.

It is therefore an object of the invention to provide a system for minimizing the amount of undesirable gaseous constituents which are passed to the atmosphere from an internal combustion engine. A further object is to operate said engine within predetermined standards which are designed to hold down the amount of possible air pollutant constituents which might otherwise be discharged into the atmosphere. A still further object is to provide means to assure a degree of uniformity in the makeup of a charge which enters the intake of the engine's cylinders during any and all operating periods.

The objectives of the invention are achieved through means of an exhaust gas mixer which is commonly communicated with the respective engine cylinders. During each cylinder's exhaust stroke, the final portion of the hot gas is introduced to a mixing chamber rather than into the engine's exhaust manifold. Within the mixing chamber, gases from each of the cylinders are readily intermixed and subsequently passed to the intake manifold or to the air inlet for mixing with the charge.

Figure 1:
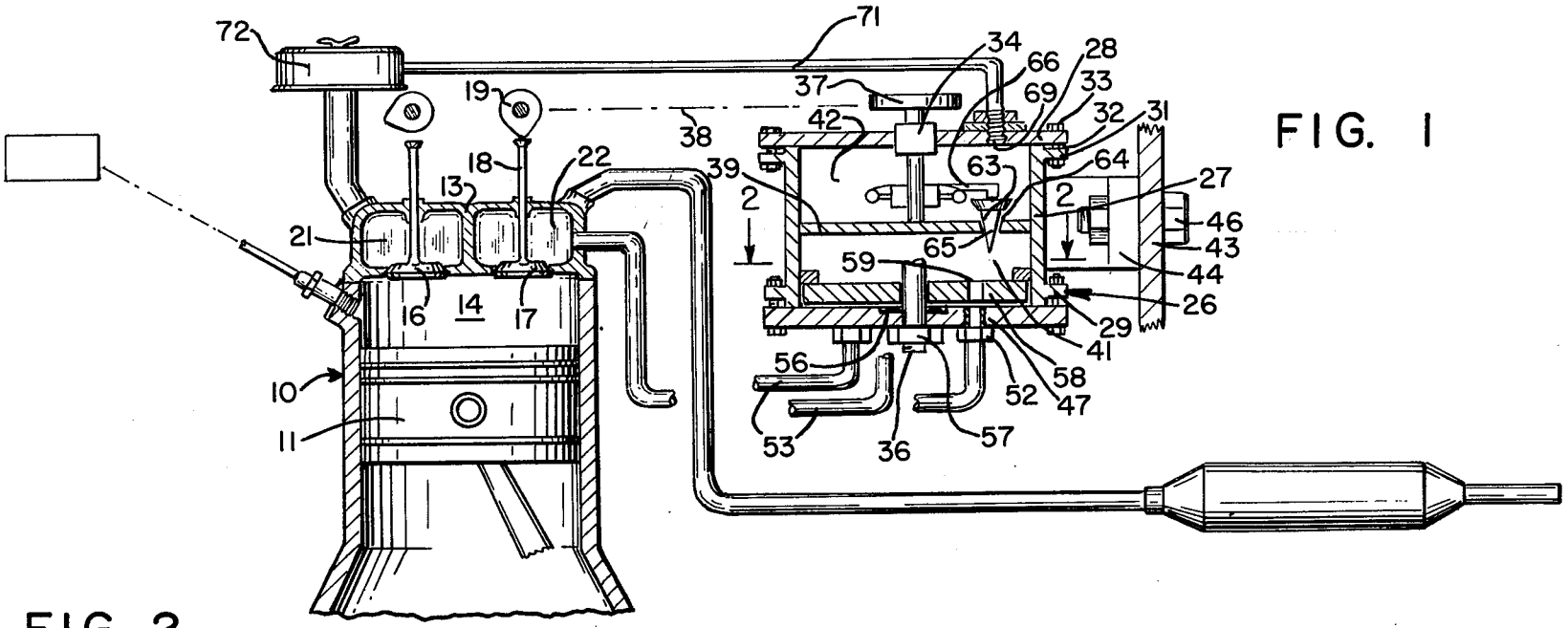
FIG. 1 is a schematic-like arrangement of an engine including the instant gas mixer showing certain parts in cross section.
Figure 3:
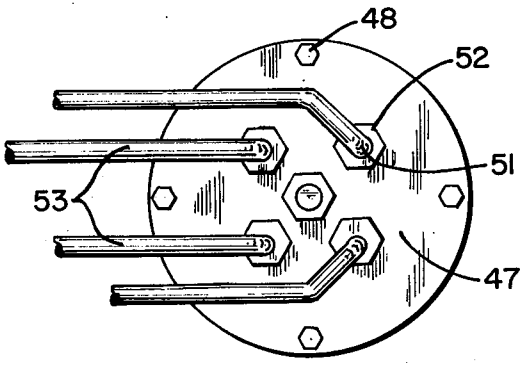
FIG. 3 is an end view taken along line 3—3 in FIG. 1.
Figure 2:
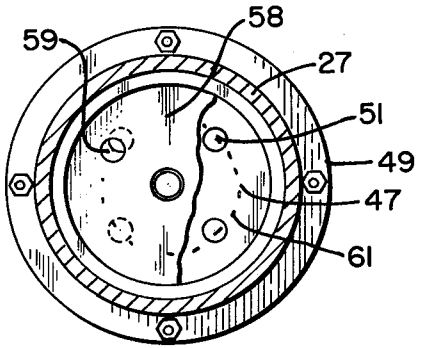
FIG. 2 is a cross sectional view taken through line 2—2 in FIG. 1.

In an engine of the type adapted for using the instant system, and referring to FIG. 1, there is provided a fuel injection engine in which the charge consists in part of fresh air drawn from the atmosphere. To this initial air, an amount of recirculated exhaust gas is added. A predetermined amount of liquid fuel is introduced to the combustion chamber through suitable injector means.

In the cross sectional view of the engine shown, a single cylinder 10 is illustrated wherein a piston 11 is reciprocally mounted and connected to a piston rod 12 which in turn is connected to the engine's main drive shaft. The upper end of piston 11 and cylinder head 13 defines a combustion chamber 14 into which intake and exhaust valves 16 and 17 are formed.

In the usual manner the respective valves 16 and 17 are driven by a suitable timing means to coordinate their motion with the motion of the piston 11 within the cylinder. Each valve, 17 for example, includes an elongated stem 18 which is contacted by a rotatable cam shaft 19 whereby to actuate the valve between open and closed positions.

The engine or cylinder head 13 is provided with manifold means including intake manifold 21 for carrying fresh charge, and exhaust manifold 22 for directing hot exhaust gases away from combustion chamber 14 during the exhaust stroke.

While the present invention is addressed to an engine of the fuel-injection type, it is understood that the instant principle of circulating a portion of hot exhaust gas can be applied equally as well to premixed charge engines, stratified charge engines, or diesel type. In any instance the hot exhaust gas is recirculated at a particular portion of the exhaust stroke such that the desired quality control can be maintained in the overall charge.

The exhaust gas mixer unit 26 comprises in general an elongated cylindrical casing 27 formed of a metal such as sheet steel, capable of withstanding the exhaust gas temperatures up to 1,000° F. Casing 27 includes flanges 28 and 29 formed at each end thereof having mounting holes to removably engage closure members.

One end of said casing 27 is provided with a rear or end closure plate 31 which is held in place against flange 28. A gasket 32 is compressed therebetween by a series of bolts 33 for assuring a gas tight seal. Said end plate 31 further includes a center opening adapted to receive a bearing 34, and having a closure cap which positions the bearing in place. Bearing 34 journals a shaft 36 which extends coaxially of casing 27, which protrudes adjacent rear wall 31 a sufficient distance to support a gear, sprocket 37 or similar member to be driven by a timing belt or chain 38.

To coordinate the speed of shaft 36 with the engine speed, said timing belt 38 engages a similar rotating member of the engine such as cam shaft 19 or the like. An inner panel 39 within mixer 26 is disposed transversely of the casing to separate the section into a mixing compartment 41 from a gas discharge compartment 42.

Mixer 26 is fixedly positioned to a portion 43 of the engine, or depends from the vehicle's chassis. In any event, mixer 26 is rigidly held by a bracket arrangement 44 having a bolt 46 or similar fastener to permit its adjustment to control the tension in the drive means.

The forward end of casing 27 is provided with a valve arrangement adapted to admit measured amounts of exhaust gas to the mixing compartment 41. Said valve arrangement comprises a forward plate 47 which sealably engages the forward flange 29 by a series of bolts 48 having a gasket 49 therebetween to assure the gas tight integrity of the seal.

A plurality of inlet ports 51 transverse said plate 47 and are disposed in a circular pattern concentric with the end of shaft 36. Said openings or ports 51 are spaced equally apart in accordance with the number of cylinders in the engine. They are further adapted to sealably receive a connection 52 which forms the end of an individual exhaust line 53.

Each inlet 51 receives a single exhaust line 53 which, in order to withstand the relatively high pressure and temperature of the exhaust gas, are normally formed of a temperature resistant metal, either flexible or rigid. Further, the lengths of said exhaust lines 53 are as much as possible minimized by placing the mixer unit 26 as close as possible to the engine. Thus, the physical distance travelled by the exhaust gas to mixer 26 will be minimized and the back pressure will likewise be minimized.

Front closure plate 47 includes a seal member 56 which operably engages rotating shaft 36. Said plate 47 also includes a forward bearing 57 which is held in the plate by a suitable housing, permitting shaft 36 to be journalled within the bearing 57.

A valve plate 58 is rigidly keyed to shaft 36 and positioned to rotate axially within the casing 27 enclosure. Said plate 58 is spaced as close as possible to forward plate 47 whereby to minimize gas leakage therebetween. Plate 58 can include a fixed type seal bearing which rotates in contact with forward plate 47, or any similar type seal member which is capable of limiting or minimizing gas leakage from the respective inlet ports 51.

A single arcuate opening 59 formed in valve plate 58 is positioned on a circular arc 61 concurrent with the circular pattern of the respective ports 51 in forward plate 47. Thus, said arcuate opening 59 sequentially registers with the respective inlet ports, thereby admitting a slug of gas to enter mixing chamber 41 so long as the two openings remain in alignment or in overlapping relationship.

The respective exhaust line connections 53 to the various engine cylinders are arranged in a circular pattern in end plate 47. Thus, as each cylinder enters its exhaust stroke, arcuate opening 59 in valve plate 58 will pass across the inlet port 51 in end wall 47. The size of opening 59 is such as to admit the desired amount of exhaust gas during a small segment of the exhaust stroke.

Within the mixing chamber 41, the hot gases received from each of the cylinder combustion chambers are brought together and mixed. The aggregate, hot mixed gas is then passed through a metering valve 63, comprised of an opening 64 formed in intermediate panel 39. Said metering valve 63 includes a tapered metering rod 65 which conforms substantially to the contour of valve opening 64.

Metering rod 65, as shown, is connected to a protruding tab depending from casing 27 inner wall. It is further connected through a suitable linkage 66 to a governor mechanism 67 carried on drive shaft 36. Operationally, as the speed of the engine, and consequently of the drive shaft 36 is increased, governor mechanism 67 will tend to open the metering valve 63 a sufficient distance to admit more gas into the mixer chamber 41. From the latter, mixed exhaust gas still under pressure will be forced through opening 69 and thence through recirculating conduit 71. The latter is communicated with a portion of the air intake system such that the mixed hot exhaust gas is injected, aspirated, or otherwise taken into the fresh air stream.

In the present arrangement the connection between gas mixer 26 and the engine, is by way of conduit 71 which communicates with air filter 72. As fresh air enters the latter, it will be intermixed with the hot, mixed exhaust gas to form the incoming charge. In the alternative, recirculating conduit 71 can be connected directly into intake manifold 21 at a single or a plurality of connections. Thus, each cylinder will receive a charge comprising air taken through air filter 72, plus an amount of recirculated exhaust gas.

Operationally, during all loading phases as the engine covers its entire range from idle to maximum load, exhaust gas will be recirculated to intake manifold 21. As herein noted, the portion of exhaust gas which contains the maximum amount of undesirable constituents will be withdrawn from each cylinder during the last 10° to 15° of cam shaft travel. Thus, positioning of the valve plate 58 is adjusted through the timing mechanism 38 such that the relationship between the intake to the mixer 26 and the exhaust cycle of the engine cylinders will be closely coordinated.

As the engine speed increases the setting of governor 67 on the mixer shaft 36 becomes adjusted. Thus, this movement, together with the shaping of the metering rod 65, will regulate the amount of gas passing from mixing chamber 62 into the predelivery or discharge compartment 68.

During normal engine operation, exhaust gas which is not drawn into the respective exhaust or recirculation lines is passed directly into the exhaust manifold 22 and thence to exhaust pipe 73. From the latter the gas will pass through the muffler 74 to be further treated or discharged into the atmosphere.

Other modifications and variations of the invention as hereinbefore set forth can be made without departing from the spirit and scope thereof, and therefore, only such limitations should be imposed as are indicated in the appended claims.

We claim:

1. In an exhaust gas recirculation system for an engine which includes; a plurality of cylinders which define a plurality of combustion chambers, intake and exhaust valves communicated with the respective combustion chambers, each intake valve being operable to introduce a charge to a combustion chamber and, each exhaust valve being operable to discharge a hot exhaust stream therefrom subsequent to said charge being fired;

an exhaust gas mixer having at least one compartment, conduit means separately communicating each of said plurality of combustion chambers with said gas mixing compartment, first valve means in said gas mixer being operable to sequentially admit an exhaust gas stream from each of said plurality of combustion chambers into said mixing compartment, and said gas mixer having a discharge port communicated with said combustion chamber intake valves to intermix a stream of mixed exhaust gas with incoming charge being directed to said respective combustion chambers.

2. In a system as defined in claim 1, including; a second valve means in said mixer being operable to regulate the flow of mixed exhaust gas leaving said gas mixer member to intermix with said incoming charge.

3. In a system as defined in claim 1, wherein; said first valve means in said gas mixer is operable to admit a stream of gas into said mixer for a limited period during the time when the exhaust valve of each combustion chamber is open.

4. In a system as defined in claim 1, wherein; said first valve means is operable to admit a flow of exhaust gas from each of said plurality of combustion chambers, only during the latter portion of the time when said exhaust valve is open.

5. In a system as defined in claim 4, wherein; said second valve means includes a metering valve communicated with said mixing compartment and being operable to regulate the flow of mixed exhaust gas which leaves said gas mixer commensurable to engine speed and load.

6. In a system as defined in claim 1, wherein; said first valve means is directly connected to said engine for coordinating the actuation of said first valve means with said engine speed.

7. Gas mixer for an internal combustion engine utilizing an exhaust gas recirculation system, which engine includes; a plurality of combustion chambers, each of the latter including a conduit means communicated therewith to conduct an exhaust gas stream from the said combustion chamber during the engine's exhaust stroke, which mixer includes;

a casing defining a mixing chamber, a forward wall forming a closure at one end of said casing, a plurality of gas inlet ports formed in said wall in a circular pattern, each port being communicated with a conduit means from one of said combustion chambers, a first valve member operably positioned contiguous with said forward wall and having a single aperture formed therein in a position to sequentially register with the respective exhaust ports, thereby admitting an exhaust gas flow from the latter, into said mixing chamber during a portion of the engine's exhaust stroke, and an exhaust port communicated with said mixing chamber for conducting a flow of mixed exhaust gas therefrom.

8. In a system as defined in claim 7, wherein said valve member includes; a plate of sufficient size to cover the respective exhaust gas inlet ports in said port wall when said plate is rotated, and to sequentially register said aperture with a single gas inlet port as the plate is rotated.

9. In a gas mixer as defined in claim 7, including; second valve means communicated with said mixing chamber being operable to regulate the flow of mixed exhaust gases flowing therefrom.

10. In a gas mixer as defined in claim 7, wherein said mixer includes; a shaft extending therethrough and being operably connected to said engine whereby to be rotated at a speed in response to engine speed, said first valve member and said second valve means being connected to said shaft to be actuated thereby as said shaft is rotated.

11. Method for operating a multi-cylinder internal combustion engine having a plurality of cylinders each thereof having intake and exhaust valves in which a portion of the engine exhaust gas is recirculated into the engine intake valve to form a part of the engine's charge which method includes the steps of;

during the segment of the time period when an exhaust valve is open, directing a portion of the exhaust gas stream from each of said cylinders into a common gas mixer, intermixing the respective exhaust gas streams within said mixer, and passing a metered stream of the mixed exhaust gas from the mixer into the engine's intake valve.

12. In the method as defined in claim 11, including; the step of concurrently regulating the inflow and outflow of exhaust gas through said gas mixer in accordance with the engine's speed.

* * * * *